United States Patent [19]

Almond et al.

[11] Patent Number: 4,571,282

[45] Date of Patent: Feb. 18, 1986

[54] PROCESS AND APPARATUS FOR BATCH DIGESTER FLUID HEAT RECLAMATION

[75] Inventors: Charles B. Almond; James S. Leonard, both of Birmingham, Ala.

[73] Assignee: Baker International Corporation, Orange, Calif.

[21] Appl. No.: 607,345

[22] Filed: May 4, 1984

[51] Int. Cl.[4] ..... D21C 11/06

[52] U.S. Cl. ..... 162/47; 162/41

[58] Field of Search ..... 162/47, 239, 41, 42

[56] References Cited

U.S. PATENT DOCUMENTS

| | | | |
|---|---|---|---|
| 1,384,796 | 7/1921 | Witham | 162/239 |
| 1,691,682 | 11/1928 | Thorne | 162/47 |
| 1,947,889 | 2/1934 | Thorne | 162/239 |
| 2,029,360 | 2/1936 | Dean | 162/47 |
| 2,874,043 | 2/1959 | Lockman | 162/47 |
| 4,138,311 | 2/1979 | Neno | 162/239 |

*Primary Examiner*—Peter Chin

*Attorney, Agent, or Firm*—Thomas E. Schatzel

[57] ABSTRACT

Apparatus and method for reclaiming heat from batch digesting operations including two fluid-to-fluid exchangers fluidically interconnected to allow the passage of an inert fluid between the heat exchangers. The inert fluid passes through the inaccessible regions of the heat exchangers promoting the exchange of heat between spent digester cooking fluid and fresh digester cooling fluid without scaling, clogging or blocking the inaccessible regions of the heat exchanger.

6 Claims, 1 Drawing Figure

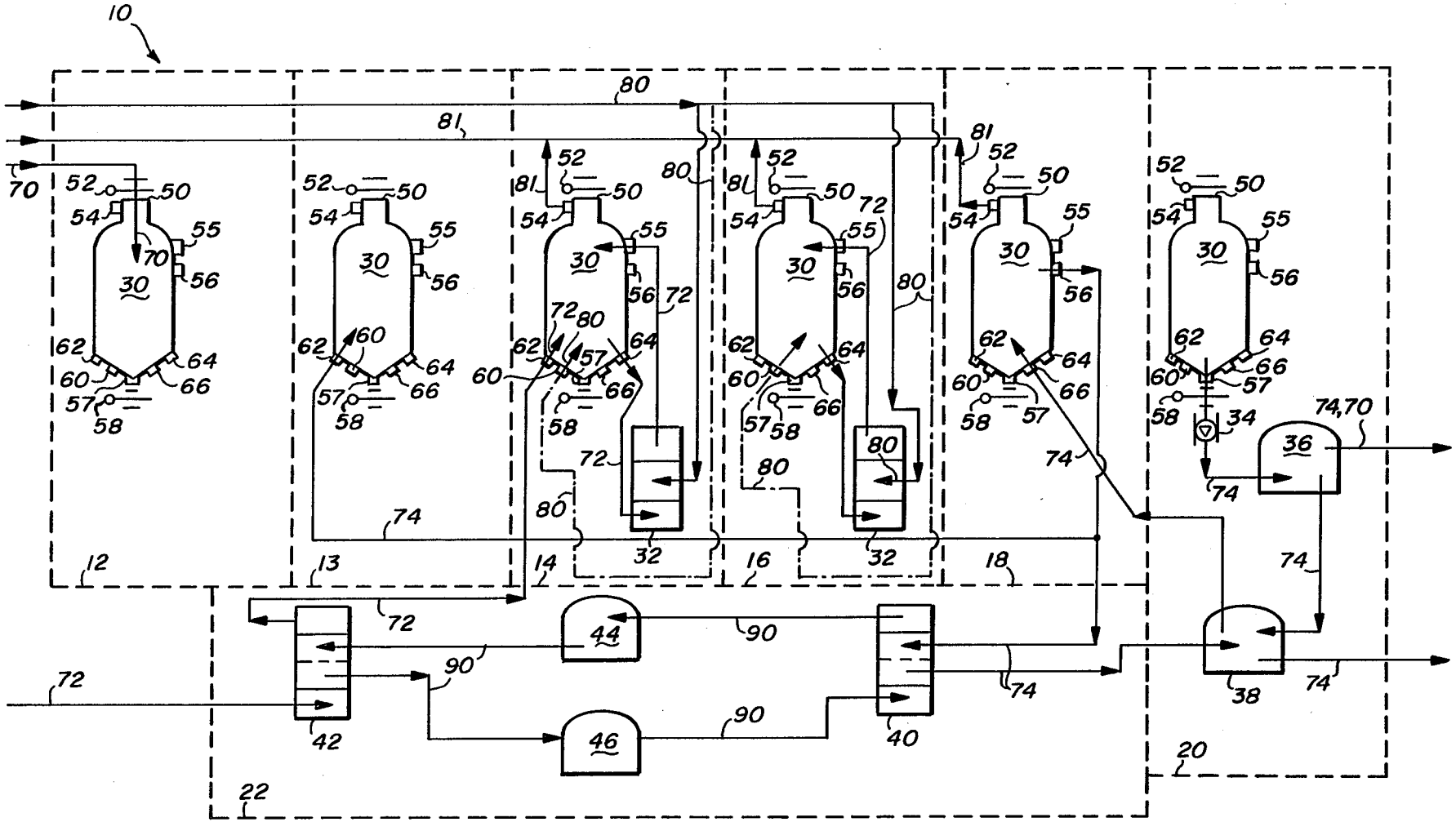

PROCESS AND APPARATUS FOR BATCH DIGESTER FLUID HEAT RECLAMATION

BACKGROUND OF THE INVENTION

1. Field of the Invention

The present invention relates generally to batch digestors and more particularly to apparatus for recovering heat from batch digester cooking fluids and a process for use thereof.

2. Description of the Prior Art

Batch digesters are commonly used in industrial applications to liberate fibrous pulp or other desired by-products from woodchips or other fibrous materials by digestion or cooking. The digestion of materials in batch digesters requires the use of heat and a highly corrosive fluid or cooking "liquor", such as sodium sulphite. To effect digestion a quantity of material is placed within a digester. This material may be preheated, exposed to a predetermined quantity of super heated cooking liquor, allowed to soak or "cook" in the cooking liquor at an elevated temperature and pressure for a predetermined time period, and then discharged from the digester and separated into the desired product and spent liquor. The spent cooking liquor is the contaminated cooking liquor which includes residue pulp liberated during the cooking process. Release of the pressure in the digester liberates energy contained in the superheated contents of the digester. Such energy may be subsequently recovered and utilized if desired.

The reclamation of heat from batch digester systems is well known in the prior art. Specifically U.S. Pat. Nos. 1,832,367 issued to T. L. Dunbar, Nov. 17, 1931; 1,860,755 issued to Stevens et al, May 31, 1932; 1,885,561 issued to Stevens et al, Nov. 1, 1932; 1,947,889 issued to C. B. Thorme, Feb. 20, 1934; and 2,216,649 issued to A. D. Merrill, Oct. 1, 1940 all discuss apparatus and processes for such heat recovery. The prior art teaches the use of direct or indirect heat exchange to transfer heat between the cooking and spent liquors. Such a heat exchange is to preheat the cooking liquor prior to its introduction into the digester. Preheating the cooking liquor in such a manner reduces the expense of independently heating the cooking liquor and reduces total processing times.

Direct heat exchange in the prior art between cooking and spent liquors is accomplished by mixing heated spent liquor with unheated cooking liquor. A major drawback to direct heat exchange is the contamination of the cooking liquor by the spent liquor resulting in lengthened cooking times.

The indirect heat exchange between the cooking and spent liquors is the preferred approach of the prior art. The indirect heat exchange between the cooking and spent liquors is accomplished by use of a fluid-to-fluid heat exchanger. Unheated cooking liquor is introduced into one portion of the heat exchanger while heated spent liquor is introduced into a second portion of the heat exchanger. The two liquors are passed near each other inside their respective portions of the heat exchanger. The heat exchange is accomplished through the walls of the heat exchanger. Neither cooking or spent liquor is allowed to contact the other liquor and contamination of the cooking liquor is avoided. Once heated, the cooking liquor is superheated. When superheated, cooking liquor is stored for future use in a pressurized accumulator to prevent release of energy from the superheated liquor.

Conventional fluid-to-fluid heat exchangers have an acccessible fluid system and an inaccessible fluid system. Both systems may be washed or flushed, but only the accessible system may be truly cleaned or descaled in case of blockage. If blockage occurs due to heavy scaling or fouling in the inaccessible portion of the heat exchanger, the heat exchanger must be replaced or rebuilt. Such replacement or rebuilding of a heat exchanger is expensive.

A disadvantage of the prior art is that it requires highly corrosive liquors to pass through the inaccessible portion of the heat exchanger resulting in fouling, scaling and general blockage of that portion of the heat exchanger. Such blocking, scaling or fouling requires the expensive rebuilding, replacement or cleaning of the heat exchanger to restore efficient heat exchanger operation.

Another disadvantage of the prior art is that it requires the use of expensive pressurized accumulators to store heated liquors.

A further disadvantage of the prior art is that it requires the use of expensive pressurized measuring equipment to accurately measure the quantity of preheated cooking liquor introduced into the digester.

SUMMARY OF THE PRESENT INVENTION

It is an object of the present invention to provide apparatus which eliminates the need to replace, rebuild, or frequently clean heat exchangers due to fouling, scaling or blocking of the inaccessible portion of the heat exchanger.

It is another object of the present invention to provide apparatus which eliminates the need for pressurized accumulators to store heated liquors.

It is another object of the present invention to provide a process that eliminates the need for pressurized measuring equipment to measure preheated cooking liquors.

Briefly, a preferred embodiment of the present invention includes apparatus to receive a quantity of corrosive fluid, i.e. a cooking liquor, at least one batch digester, a quantity of live steam, at least two fluid-to-fluid heat exchangers, a quantity of inert non-corrosive non-fouling fluid, a non-pressurized inert fluid reservoir, a non- pressurized cooled inert fluid reservoir, and a non-pressurized cooled spent liquor storage tank. The preferred embodiment further includes an assortment of valves, piping and other plumbing to fluidly interconnect the aforementioned apparatus.

To utilize a preferred embodiment a quantity of material to be digested is deposited in the batch digester. The material to be digested is then exposed to a predetermined quantity of heated cooking liquor. The cooking liquor mixes with the material to be digested. The mixture remains in the digester for a predetermined time until a desired level of digestion of the material has occurred. After digestion, a mixture of spent cooking liquor, digested material and dissolved organic compounds remain within the digester. The mixture of spent cooking liquor and dissolved organic material are collectively referred to as spent liquor. The heated spent liquor is then displaced from the mixture by cooled spent liquor. The super heated spent liquor is exhausted from the digester through a first heat exchanger to a cooled spent liquor storage tank. The cooled spent liquor-digested material mixture is withdrawn from the digester and stored for future processing.

The heated spent liquor displaced from the digester and a quantity of unheated inert fluid are simultaneously passed through the first heat exchanger to heat the unheated inert fluid and cool the heated spent liquor. The heated spent liquor is passed through the accessible portion of the first heat exchanger while the unheated inert fluid is passed through the inaccessible portion of the first heat exchanger. Once cooled, the spent liquor is stored for future use in the cooled spent liquor storage tank. The heated inert fluid is then passed into a second heat exchanger, or stored in the heated inert fluid reservoir if its use is not immediately required. When required, the heated inert fluid is passed through the second heat exchanger simultaneously with a predetermined quantity of unheated cooking liquor. The second heat exchanger cools the heated inert fluid and heats the unheated cooking liquor. The unheated cooking liquor is passed through the accessible portion of the second heat exchanger while the heated inert fluid flows through the inaccessible portion of the second heat exchanger. Cooking liquor heated in the second heat exchanger is then introduced into the digester. The cooled inert fluid is stored in the cooled inert fluid reservoir for future use or immediately passed through the first heat exchanger to start the heat exchange process over again.

The preferred embodiment of the present invention envisions a continuous closed loop system for the inert fluid. The closed system utilizes heat from the heated spent liquor to heat unheated cooking liquor without exposing the inaccessible portions of the heat exchanger to corrosive fouling liquors.

One advantage of the present invention is that the inaccessible portions of the heat exchangers are not exposed to any corrosive liquors, eliminating blockage, fouling, or scaling of the inaccessible portion of the heat exchanger.

Another advantage of the present invention is the possibility of the use of non-pressurized reservoirs to store the inert fluid. When the proper inert fluid is chosen the heated inert fluid is not volatile, eliminating the need for pressurized accumulators, thus minimizing operational costs associated with batch digesting.

Another advantage of the present invention is its use of inert fluid as a means to effectively recover waste heat energy from the spent liquor without heating any cooking liquor until such is required. Thus, exact quantities of unheated cooking liquor may be measured by non-pressurized measurement equipment for use in the digester prior to heating.

These and other objects and advantages of the present invention will no doubt become obvious to those of ordinary skill in the art after having read the following detailed description of the preferred embodiment which is illustrated in the drawing FIGURE.

IN THE DRAWING

FIG. 1 is a schematic diagram of apparatus for a batch digesting process according to the present invention and further illustrating the batch digesting process according to the present invention segmented into operational cycles.

DETAILED DESCRIPTION OF THE PREFERRED EMBODIMENT

FIG. 1 illustrates a schematic diagram of a batch digesting system according to the present invention referred to by a general reference character 10. To more clearly illustrate the operation of system 10, system 10 is subdivided, by a series of dashed lines, into seven operations. The operations include a material fill operation 12, a presoak operation 13, a cooking liquor fill operation 14, a cooking operation 16, a displacement operation 18, a discharge operation 20, and a heat exchange operation 22. A number of the elements of system 10 are repeated in operations 12, 13, 14, 16, 18 and 20. Such duplication of the elements is not required for the functioning of the present invention, and is shown merely for ease of description.

System 10 includes a digester 30, a cooking heater 32, a pump 34, a blow tank 36, a cooled spent liquor storage tank 38, a first heat exchanger 40, a second heat exchanger 42, a heated inert fluid reservoir 44, a cooled inert fluid reservoir 46, and a variety of plumbing (not shown) comprising valves and piping to fluidically interconnect the apparatus.

It should be understood that each operation 12, 13, 14, 16, 18, 20 and 22 does not require all of the aforementioned apparatus or distinct apparatus. For example, all the operations may be conducted with one digester 30, and two heat exchangers 40 and 42. Likewise, system 10, depending on its application, may utilize multiples of any of the apparatus, e.g. system 10 may employ a plurality of digesters 30 and cooking heaters 32 if so desired. Additionally, system 10 may function without cooking heater 32 when direct steam (to be discussed hereinafter) is injected into digester 30. Such a system is illustrated by dot-dashed lines (to be discussed hereinafter) in operations 14 and 16.

Each digester 30 includes an upper cylindrical portion and a lower cylindrical portion. The upper portion has an upper opening 50, an upper opening cover 52, and a steam relief conduit 54. Digester 30 further includes a liquor reintroduction passage 55, a liquor displacement conduit 56, a lower opening 57 and a lower opening cover 58, a steam introduction passage 60, a liquor introduction passage 62, a liquor outlet conduit 64, and displacement passage 66. Digester 30 must be capable of enclosing a predetermined quantity of material 70, referenced by line 70, to be digested, such as woodchips or other fibrous material, and a predetermined quantity of cooking fluid (to be discussed hereinafter). Digester 30 is pressurized to prevent spontaneous boiling of heated cooking fluid and material 70.

The cooking fluid used in system 10 may be a corrosive chemical such as sodium sulfide. In system 10 there are two fluids, a cooking liquor 72, and a spent liquor 74. The cooking liquor is referenced by line 72 and the spent liquor by the line 74. The difference between cooking liquor 72 and spent liquor 74 is chemical composition, specifically, the amount of impurities present in each liquor. Cooking liquor 72 is a relatively pure inorganic solution fluid while spent liquor 74 is chemically altered due to chemical reactions that transpire during cooking operation 16 and contains substantial quanities of impurities, such as water, ligin and other non-fibrous waste materials. Spent liquor 74 along with pulp resides in digester 30 after cooking operation 16 is terminated. During cooking operation 16, cooking liquor 72 is transformed into spent liquor 74 as material 70 is digested.

Cooking heater 32, used in operations 14 and 16 may be a conventional industrial design capable of heating predetermined quantities of cooking liquor 72. The exact requirements for cooking heater 32 are dependent on the choice of cooking liquor 72 and material 70. In FIG. 1 cooking heater 32 is a standard steam heater.

Blow tank 36 may also be of a conventional design capable of containing spent liquor 74 and material 70 when such is discharged from digester 30. In blow tank 36 spent liquor 74 may be separated from material 70 if a pulp washing operation (not shown) is utilized.

Cooled spent liquor storage tank 38, heated inert fluid reservoir 44 and cooled inert fluid reservoir 46 may all be of non-pressurized conventional design. Each must be capable of containing a predetermined quantity of liquid. The exact quantity of liquid to be contained is dependent on the design of system 10.

The first heat exchanger 40 and second heat exchanger 42 may also be of conventional fluid-to-fluid heat exchanger design having an accessible region and a inaccessible region through which fluids to be heated and cooled pass. Heat exchangers 40 and 42 function by passing a heating fluid and a fluid to be heated through the heat exchanger simultaneously. Heat exchange between the two fluids is effected through the walls of the heat exchanger. A fluidized bed heat exchanger can also be used for heat exchanger 40 and/or 42. Such a fluidized bed heat exchanger is disclosed in U.S. Pat. No. 4,119,136 issued to Klaren on Oct. 10, 1978.

The aforementioned components of system 10 must be capable of containing and in some instances conveying the liquors without allowing the escape of either cooking liquor 72 or spent liquor 74.

As illustrated in FIG. 1 the operation of system 10 includes seven overlapping operations. For ease of description, each operation will be individually addressed in relation to the other operations. In material filling operation 12, digester 30 is filled with a predetermined amount of material 70. Such filling is accomplished by opening cover 52, passing material 70 through opening 50 and closing and securing cover 52.

After operation 12, presoak operation 13 may be utilized wherein material 70 is presoaked in heated spent liquor 74. Heated spent liquor 74 is introduced into digester 30 via liquor introduction passage 62. Presoak operation 13 is not always required and may be omitted if desired. However, use of presoak operation 13 improves operating economy by conserving use of live steam 80, referenced by line 80, and increasing the yield of material 70. Under certain conditions use of presoak operation 13 may induce changes in the physical properties of material 70 and should be avoided.

Cooking liquor filling operation 14 is commenced after material fill operation 12 or 13 is completed. During operation 14 a predetermined quantity of cooking liquor 72, either preheated by second heat exchanger 42 as shown or unheated, is introduced into digester 30 through liquor introduction passage 62. When operation 14 follows presoak operation 13, cooking liquor 72 displaces spent liquor 74. The introduction of cooking liquor 72 creates a cooking mixture of cooking liquor 72 and material 70. Cooking heater 32 is heated by live steam 80 as illustrated. If cooking heater 32 is not utilized live steam 80 may be directly introduced into digester 80 via steam introduction passage 60 as shown in operrations 14 and 16 by dot-dash line 80. The introduction of cooking liquor 72 displaces an undetermined amount of gases 81 liberated from material 70 by live steam 80, cooking liquor 72 and/or heated spent liquor 74 if operation 13 is utilized. Displaced steam 81 exits digester 30 through steam released conduit 54.

After cooking liquor fill operation 14 is complete, cooking operation 16 is commenced. Operation 16 requires soaking or cooking of material 70 in cooking liquor 72 for a predetermined time at a predetermined temperature and pressure. Cooking time is dependent on temperature and choice of cooking liquor 72 and material 70 as discussed. During cooking operation 16 the temperature of cooking liquor 72 and material 70 is maintained by circulation of cooking liquor 72 through cooking heater 32 or by direct steam 80 injection into digester 30 via steam introduction passage 60. If steam heater 32 is utilized cooking liquor 72 circulates through cooking heater 32 and re-enters digester 30 through liquor reintroduction passage 55. During cooking operation 16 cooking liquor 72 is contaminated by waste by-products of material 70, such as water, ligin, and other non-fibrous components of material 70. Contamination of cooking liquor 72 results in cooking liquor 72 becoming spent liquor 74 upon the completion of cooking operation 16.

After cooking operation 16 is completed, displacement operation 18 is commenced. Displacement operation 18 entails the introduction of a quantity of cooled spent liquor 74 into digester 30. Cooled spent liquor 74 flows into digester 30 through liquor displacement passage 66. Heated spent liquor 74 residing within digester 30, being less dense than cooled liquor 74, and is displaced by cooled liquor 74. The displaced heated liquor 74 rises to the upper portions of digester 30 and exits digester 30 through liquor displacement conduit 56. After heated liquor 74 is removed from digester 30 it is passed through first heat exchanger 40 and/or liquor introduction passage 62 in presoak operation 13.

The functioning of first heat exchanger 40 and second heat exchanger 42 is paramount to the operation of system 10. The operation of heat exchangers 40 and 42 is shown as heat exchange operation 22. In operation 22, an inert fluid as referenced by line 90, is circulated between heat exchangers 40 and 42 to convey heat from heated spent liquor 74 to unheated cooking liquor 72. Inert fluid 90 must be a non-corrosive, non-fouling liquid. Use of a non-volatile liquid for inert fluid 90 is recommended. When such a liquid is chosen for inert fluid 90 the need to store heated fluid 90 in pressurized accumulators is eliminated. Silicone oil or softened water are suitable for use as inert fluid 90. When softened water is utilized as inert fluid 90 reservoirs 44 and 46 should be pressurized. Inert fluid 90 is passed through the inaccessible regions of both heat exchangers 40 and 42 during operation 22.

In conventional batch digesting systems cooking liquor 72 or spent liquor 74 are passed through the inaccessible portions of a heat exchanger resulting in scaling, fouling or blockage of the heat exchanger. Such scaling, fouling or blockage reduces the efficiency of the heat exchanger and requires cleaning and possible dismantling or replacement of the heat exchanger to regain lost efficiency. Use of inert fluid 90 in the inaccessible portions of heat exchangers 40 and 42 eliminate such cleaning, refurbishing or replacement. Scaling, fouling or blockage is alleviated in the inaccessible portions of heat exchangers 40 and 42 as inert fluid 90 is non-corrosive and does not cause heat exchanger scaling. In conventional digester systems frequent cleaning of the inaccessible portions of the heat exchanger is performed in an attempt to prevent such scaling, fouling or blockage. Such cleanings render the heat exchanger temporarily useless for performing its function. Interruption of the digestion process is required when the heat exchanger is cleaned unless backup reserve heat exchangers are utilized or direct steam injection is used. The frequent cleaning of the heat exchanger, the use of backup heat exchangers, or the use of direct steam injection is expensive. System 10 eliminates such interruptions, the need to have backup heat exchangers available or the need to use direct steam injection.

In heat exchange operation 22 the first heat exchanger 40 is used to transfer heat from heated spent liquor 74, displaced from digester 30 during displacement operation 18, to inert fluid 90. Once heated, inert fluid 90 can be stored in heated inert fluid reservoir 44, for future use, or immediately passed through second heat exchanger 42. Simultaneously with the passage of heated inert fluid 90 through second heat exchanger 42, unheated cooking liquor 72 is passed through the accessible portion of heat exchanger 72. Heat is transferred between heated inert fluid 90 and unheated cooking liquor 72 through the walls of the heat exchanger creating a preheated cooking liquor 72. Preheated cooking liquor 72 may be introduced into digester 30 by liquor introduction passage 62 during liquor filling operation 14. While passing through heat exchanger 42 heated inert fluid 90 is cooled. In this cooled state inert fluid 90 can be stored in cooled inert fluid reservoir 46 until required for future use in heat exchanger 40. Heat exchange operation 22 is a closed system not requiring the addition of inert fluid 90 once operation 22 is properly functioning.

An additional benefit of operation 22 is that it does not heat any cooking liquor 72 before such is required in operation 14. Thus, cooking liquor 72 need not be stored in expensive pressurized accumulators to avoid spontaneous boiling. Furthermore, cooking liquor 72 can be premeasured before its introduction into heat exchanger 42 by non-pressurized measurement equipment. The use of such non-pressurized measurement equipment is not possible when certain prior art methods and apparatus for preheating cooking liquor 72 are utilized.

Subsequent to displacement operation 18, discharge operation 20 is commenced. During discharge operation 20 cooled spent liquor 74, used to displace heated liquor 74 in displacement operation 18, and digested material 70 are removed from digester 30 by pump 34 or via compressed air (not shown). The mixture of cooled spent liquor 74 and digested material 70 is deposited in blow tank 36. Digested material 70 can then be removed for further processing to remove spent liquor.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. An improved heat recovery method in which digestible material is placed in a pressurized batch digester with a cooking liquor and cooked under pressure to create a spent liquor, the improvement comprising:

passing the pressurized spent liquor directly from the digester through a first portion of a first fluid-to-fluid heat exchanger;

passing an inert heat exchange fluid through a second portion of said first heat exchanger while simultaneously passing the pressurized spent liquor through the first heat exchanger to heat the heat exchange fluid with the sensible heat of said pressurized spent liquor without vapor generation;

passing said pressurized spent cooking liquor into a holding tank;

passing said heated inert heat exchange fluid through a first portion of a second fluid-to-fluid heat exchanger;

passing the cooking liquor through a second portion of the second heat exchanger simultaneously with passage of the heated heat exchange fluid through the second heat exchanger to cool the heated heat exchange fluid while heating the cooking liquor to create a quantity of preheated cooking liquor;

conveying the cooled heat exchange fluid to the first heat exchanger; and conveying the preheated cooking liquor into the digester.

2. The heat recovery method of claim 1 wherein heated pressurized spent liquor is displaced from a spent liquor-undigested material slurry by cooled spent liquor while the slurry remains within the digester and the displaced heated spent liquor from the digester is conveyed to the first heat exchanger to heat heating the heat exchanger fluid.

3. The heat recovery method of claim 1 wherein heated heat exchanger fluid from the first heat exchanger is stored in a non-pressurized reservoir.

4. The heat recovery method of claim 1 wherein cooled heat exchanger fluid from the second heat exchanger is stored in a non-pressurized reservoir.

5. The heat recovery method of claim 2, wherein heated heat exchanger fluid from the first heat exchanger is stored in a non-pressurized reservoir.

6. The heat recovery method of claim 2 wherein cooled heat exchanger fluid from the second heat exchanger is stored in a non-pressurized reservoir.

* * * * *